US012324949B2

(12) United States Patent
Hu

(10) Patent No.: US 12,324,949 B2
(45) Date of Patent: Jun. 10, 2025

(54) TREADMILL LIFTING BASE

(71) Applicant: Hao Hu, Zhejiang (CN)

(72) Inventor: Hao Hu, Zhejiang (CN)

( * ) Notice: Subject to any disclaimer, the term of this patent is extended or adjusted under 35 U.S.C. 154(b) by 171 days.

(21) Appl. No.: 18/365,179

(22) Filed: Aug. 3, 2023

(65) Prior Publication Data

US 2024/0042268 A1 Feb. 8, 2024

(30) Foreign Application Priority Data

Aug. 3, 2022 (CN) ..... 202222034472.1

(51) Int. Cl.
*A63B 22/00* (2006.01)
*A63B 22/02* (2006.01)

(52) U.S. Cl.
CPC ..... *A63B 22/0023* (2013.01); *A63B 22/02* (2013.01); *A63B 2225/093* (2013.01)

(58) Field of Classification Search
CPC . A63B 22/0023; A63B 22/0046; A63B 22/02; A63B 22/0235; A63B 71/00; A63B 2210/00; A63B 2210/50; A63B 2210/56; A63B 2225/09; A63B 2225/093
See application file for complete search history.

(56) References Cited

U.S. PATENT DOCUMENTS 4,344,616 A * 8/1982 Ogden ..... A63B 22/0023 482/54
4,374,587 A * 2/1983 Ogden ..... A63B 22/0023 482/54
4,576,352 A * 3/1986 Ogden ..... A63B 22/0023 248/188.4
4,602,779 A * 7/1986 Ogden ..... A63B 22/0023 482/54
4,759,540 A * 7/1988 Yu ..... A63B 22/0023 482/901
5,382,207 A * 1/1995 Skowronski ..... A63B 22/02 482/904
5,484,362 A * 1/1996 Skowronski ..... A63B 22/0214 482/54
6,964,632 B1 * 11/2005 Ko ..... A63B 22/0023 482/54
11,298,576 B2 * 4/2022 Yoo ..... A63B 21/154
2003/0064862 A1 * 4/2003 Hald ..... A63B 22/0023 482/51

(Continued)

FOREIGN PATENT DOCUMENTS

CN 112121353 A * 12/2020 ..... A63B 22/0214
CN 112337046 A * 2/2021

(Continued)

*Primary Examiner* — Gary D Urbiel Goldner

(57) ABSTRACT

A treadmill lifting base includes a base; a driving unit arranged on the base; a plurality of support units, at least a part of the support units being arranged on a ground surface, and including threaded sleeves; and a plurality of screw units threadedly arranged on the threaded sleeves, each of the screw units including a matching portion capable of driving the base to move synchronously. The treadmill lifting base can realize synchronous lifting of two ends on a same side of a treadmill base with a smooth, fast and reliable lifting action, and has a small-volume lifting structure, and a lifting base with a wide application range.

9 Claims, 5 Drawing Sheets

(56) References Cited

U.S. PATENT DOCUMENTS

| | | | | |
|---|---|---|---|---|
| 2005/0255969 | A1* | 11/2005 | Smith | A63B 22/0023 482/54 |
| 2010/0083793 | A1* | 4/2010 | Ko | F16H 25/20 74/640 |
| 2021/0069540 | A1* | 3/2021 | Yoo | A63B 21/00069 |

FOREIGN PATENT DOCUMENTS

| | | | | |
|---|---|---|---|---|
| EP | 1925340 | A1 * | 5/2008 | A01K 15/02 |
| GB | 2407994 | A * | 5/2005 | A63B 22/0235 |
| KR | 20140139202 | A * | 12/2014 | |
| KR | 102208745 | B1 * | 1/2021 | |

* cited by examiner

TREADMILL LIFTING BASE

CROSS-REFERENCE TO RELATED APPLICATIONS

This application claims priority of Chinese Patent Application No. 202222034472.1, filed on Aug. 3, 2022, the entire contents of which are incorporated herein by reference.

TECHNICAL FIELD

The present disclosure relates to the technical field of treadmills, in particular to a treadmill lifting base.

BACKGROUND

Treadmill is a commonly used fitness equipment. An existing treadmill platform is generally parallel to the ground. A person stands on the treadmill platform to walk or run. In order to simulate a slope segment or improve the running effect, a lifting mechanism is usually arranged at one side of the treadmill platform, so that the treadmill platform can have a certain inclination angle through the lifting mechanism.

The existing lifting base needs to be additionally equipped with a positioning bracket, such as the Chinese Patent Application with a publication number of CN112337046A, in which one end of the treadmill platform is assembled on a bracket, and the treadmill platform needs to be locked or unlocked through a plurality of connectors mounted on the bracket, and the locking or unlocking needs to be operated manually, which is inconvenient. Moreover, a user needs to pause the running during the adjustment, and it is impossible to quickly adjust the inclination angle of the treadmill platform during running. In order to facilitate the user's operation, the applicant makes some improvements.

SUMMARY

The present disclosure provides a treadmill lifting base convenient for a user to operate to overcome deficiencies in the related art.

In order to solve the above technical problems, the present disclosure is realized through the following technical solutions: a treadmill lifting base, including:

a base;

a driving unit arranged on the base;

a plurality of support units, at least a part of the support units being arranged on the ground, and including threaded sleeves; and a plurality of screw units threadedly arranged on the threaded sleeves, and directly connected to the driving unit in transmission or connected to the driving units through a plurality of transmission components in transmission, each of the screw units including or being arranged with a matching portion capable of driving the base to move synchronously, and at least one end of the base being capable of lifting along with the screw unit when the screw unit is driven by the driving unit to rotate.

In the above technical solution, preferably, the support unit includes a support block capable of being arranged on the ground, inner sleeves positioned on the support block, and threaded sleeves arranged at the inner sleeves, the threaded sleeves being positioned circumferentially relative to the inner sleeves.

In the above technical solution, preferably, a polygonal positioning piece is fixedly arranged on the support block, lower ends of the inner sleeves are fitted to the positioning piece, and a shape of at least the lower ends of the inner sleeves are matched to a shape of the polygonal positioning piece to make the inner sleeves circumferentially positioned relative to the polygonal positioning piece;

each of the threaded sleeves includes a built-in portion built into the inner sleeve and a radially extending outer edge portion, the outer edge portion being arranged at an upper end of the inner sleeve;

an outer diameter of the outer edge portion is matched to an outer diameter of the inner sleeve, the outer edge portion being flush with two opposite walls of the inner sleeve; and the threaded sleeve, the inner sleeve and the polygonal positioning piece are all square in shape.

In the above technical solution, preferably, the base includes a plurality of outer sleeves for assembling the screw units and/or the support units, the outer sleeves are arranged with transmission assembly boxes capable of being positioned relative to the outer sleeves, upper ends of the screw units penetrate through through-holes on the transmission assembly boxes and extend into the transmission assembly boxes, and are connected to the transmission components arranged in the transmission assembly boxes in transmission, and the transmission components are connected to the driving unit in transmission.

In the above technical solution, preferably, two sides of one end of the base have the outer sleeves, and the screw units on two outer sleeves are connected through a transmission shaft in transmission to cause the two screw units to move synchronously.

In the above technical solution, preferably, the screw unit includes a screw upper portion and a screw lower portion, the screw upper portion penetrates through the through-hole on the transmission assembly box and extends into the transmission assembly box, and an outer diameter of the screw lower portion is greater than a diameter of the through-hole to form the matching portion; and an outer diameter of the screw upper portion is matched to the outer diameter of the through-hole.

In the above technical solution, preferably, a bearing is arranged between a portion of the screw upper portion located in the transmission assembly box and the transmission assembly box;

a plane bearing is arranged between a portion of the screw upper portion located outside the transmission assembly box and the transmission assembly box, an outer diameter of the plane bearing is greater than the diameter of the through-hole, and when the screw unit is driven to rotate upwards, the base is driven to move synchronously by the cooperation of the matching portion, the plane bearing and a corresponding wall of the transmission assembly box;

the outer sleeve is fixedly connected to the transmission assembly box through a fastener;

a sliding sleeve is arranged between a lower end of the outer sleeve and the inner sleeve, and slidably sleeved on the inner sleeve;

the outer sleeve is fixedly connected to the sliding sleeve through a fastener; and the driving unit is a motor or a hand crank.

In the above technical solution, preferably, a first bevel gear is connected to the driving unit in transmission, arranged in a corresponding transmission assembly box and connected to at least a second bevel gear on the upper end of one of the screw units and a third bevel gear on the transmission shaft in transmission.

In the above technical solution, preferably, the driving unit is built into the base and connected to the first bevel gear in transmission, the first bevel gear is connected to a fourth bevel gear on the transmission shaft in transmission, and two ends of the transmission shaft extend into two corresponding transmission assembly boxes and are connected to the second bevel gear on the upper end of the screw unit through a corresponding bevel gear in transmission.

In the above technical solution, preferably, the driving unit is connected to the transmission shaft through a transmission belt in transmission, and the two ends of the transmission shaft extend into the two corresponding transmission assembly boxes and are connected to the second bevel gear on the upper end of the screw unit through the corresponding bevel gear in transmission.

The present disclosure has the following beneficial effects. The present disclosure provides a treadmill lifting base convenient for a user to operate, can realize synchronous lifting of two ends on a same side of the treadmill base with a smooth, fast and reliable lifting action, and has a compact and small-volume lifting structure that can be built in, and a lifting base with a wide application range.

DETAILED DESCRIPTION

The present disclosure will be further described in detail with the attached drawings and specific embodiments.

Example 1

Figure 1:
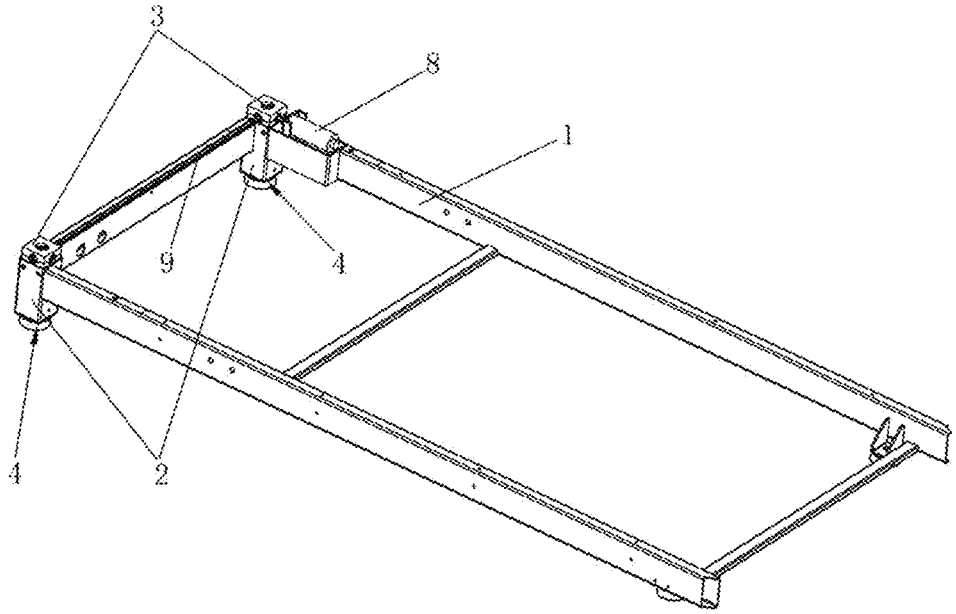
FIG. 1 is a schematic structural view of Example 1 according to the present disclosure.

With reference to FIGS. 1-4, a treadmill lifting base includes a base 1. One end of the base 1 can be lifted through a relevant lifting structure; and in order to make the one end of the base 1 lift more smoothly, outer sleeves 2 are arranged at two end corners of the one end of the base 1. As shown in FIG. 1, upper ends of the outer sleeves 2 are equipped with transmission assembly boxes 3, and each of the upper ends of the outer sleeves 2 can be fixedly connected to each of the transmission assembly boxes 3 through fasteners, such as bolts; and the outer sleeves 2, as a part of the base 1, are fixedly connected to or integrally formed with remaining pipe fittings of the base 1.

Figure 2:
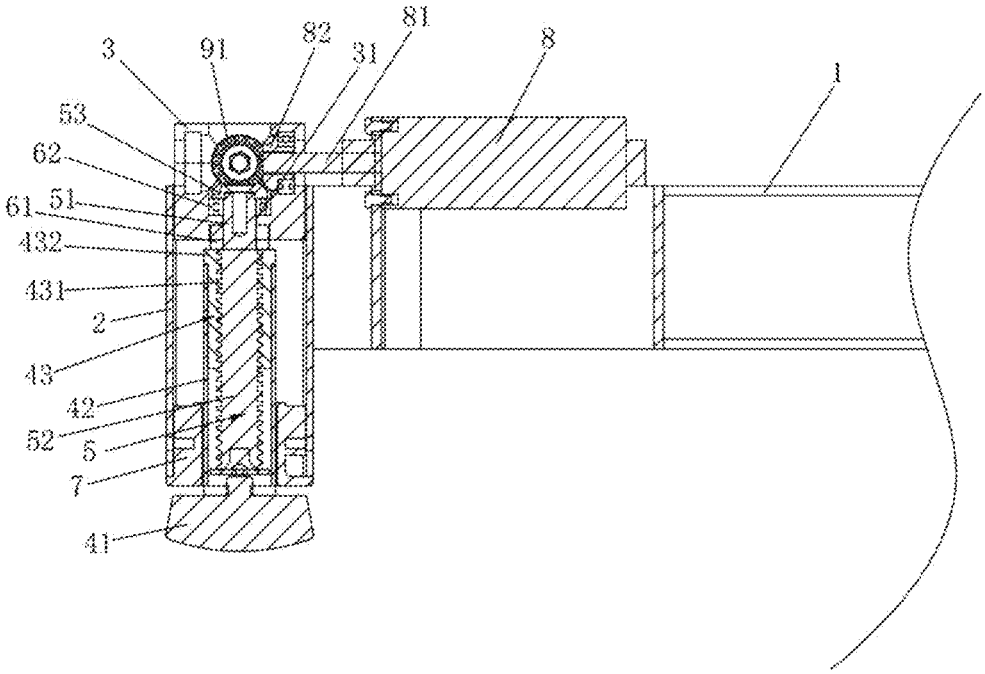
FIG. 2 is a schematic view of a sectional structure of Example 1 according to the present disclosure.

A plurality of support units 4 are arranged, and at least a part of the support units 4 is capable of being arranged on the ground. As shown in FIGS. 1 and 2, the support unit 4 includes a support block 41, inner sleeves 42 and threaded sleeves 43. The support block 41, as a ground support component, can be arranged on the ground, and a surface contacting the ground can be an arc-shaped surface in a convex form; the inner sleeves 42 are positioned on the support block 41 and can be positioned circumferentially relative to the support block; and the threaded sleeves 43 are arranged on the inner sleeves 42 and can be positioned circumferentially relative to the inner sleeves 42.

In the example, in one form, the inner sleeves 42 are positioned on the support block, and in another form, a polygonal positioning piece, such as a quadrilateral or square positioning piece, is fixedly arranged on the support block 41. Lower ends of the inner sleeves 42 are fitted to the polygonal positioning piece, and a shape of the lower end of the inner sleeve 42 is matched to a shape of the polygonal positioning piece, such as a quadrilateral or square, so that the inner sleeve 42 is circumferentially positioned relative to the polygonal positioning piece. Furthermore, a shape of the threaded sleeve 43 can also be a quadrilateral or square, the threaded sleeve 43 can be sleeved on the upper end of the inner sleeve 42, and limited by an inner wall of the inner sleeve 42 to be circumferentially positioned. Specifically, each of the threaded sleeves 43 can include a built-in portion 431 built into the inner sleeve 42 and a radially extending outer edge portion 432, the outer edge portion 432 is arranged at the upper end of the inner sleeve 42, and an inner wall of the threaded sleeve 43 is internally threaded, as shown in FIG. 2.

As more detailed features, an outer diameter of the outer edge portion 432 is matched to an outer diameter of the inner sleeve 42, and the outer edge portion 432 is flush with two opposite walls of the inner sleeve 42.

A plurality of screw units 5 are arranged, and the screw units 5 are threadedly arranged on the threaded sleeves 43. The screw units 5 have external threads and are threadedly connected to the threaded sleeves 43. When the screw units 5 are rotated, since the threaded sleeves 43 are restricted by the inner sleeves 42 and the support block 41, the screw units cannot move, so that the screw units 5 are lifted upwards during the rotation. The screw units 5 further include or are arranged with a matching portion capable of driving the base to move synchronously; therefore, when the screw units 5 are lifted upwards, one end of the base 1 can be driven to lift along with the screw units to realize the lifting of the base 1. A falling principle of the base 1 is similar.

With regard to the cooperation between the screw units 5 and the base 1, in the example, the screw unit 5 includes a screw upper portion 51 and a screw lower portion 52, an outer diameter of the screw upper portion 51 is less than an outer diameter of the screw lower portion 52, the screw upper portion 51 can penetrate through the through-hole 31 on the transmission assembly box 3 and extend into the transmission assembly box 3, and the outer diameter of the screw upper portion 51 can be matched to an outer diameter of the through-hole 31; and the outer diameter of the screw lower portion 52 is greater than a diameter of the through-hole 31 and cannot penetrate through the through-hole 31; therefore, an upper edge of the screw lower portion 52 forms the matching portion, and when the screw unit 5 is lifted upwards, the upper edge of the screw lower portion 52 provides a contact position to drive the base 1 to lift synchronously; when the screw unit 5 is lowered, the base 1 may be lowered in combination with the gravity.

Since the rotation of the screw unit 5 will generate friction with a corresponding contact surface, a plane bearing 61 can be sleeved on the screw upper portion 51. The plane bearing 61 can be specifically located on a portion, located outside the transmission assembly box 3, of the screw upper portion 51, and located below the transmission assembly box 3. Of course, an outer diameter of the plane bearing 61 needs to be greater than the outer diameter of the through-hole 31 to replace the screw lower portion 52 to contact a bottom surface of the transmission assembly box 3. Furthermore, the bottom surface of the transmission assembly box 3 can be disposed with a groove for accommodating the plane bearing 61, as shown in FIG. 2.

In the example, a bearing 62 is arranged on a portion of the screw upper portion 51 located in the transmission assembly box 3, and specifically, a corresponding groove is disposed on an inner bottom surface of the transmission assembly box 3, and the bearing 62 is accommodated in the groove, as shown in FIG. 2.

However, in order to improve the lifting stability of the base 1, a sliding sleeve 7 can be arranged between the outer sleeve 2 and the inner sleeve 42, as shown in FIG. 2. The sliding sleeve 7 is slidably sleeved on the inner sleeve 42, and the sliding sleeve 7 can be fixedly connected to the outer sleeve 2 through a fastener.

With regard to transmission-related components, in the example, the screw unit 5 is connected to the driving unit 8 in transmission, the driving unit 8 is arranged on the base 1 as a power source. The driving unit 8 and the screw unit 5 can be directly connected in transmission, such as directly driving the screw unit 5 to rotate, and also can be connected by a plurality of transmission components in transmission, such as in the form of a transmission shaft 9 or a plurality of bevel gears arranged therebetween.

As shown in FIGS. 1-4, in the example, the driving unit 8 is a motor, which can be arranged on a longitudinal pipe fitting of the base 1 or a component extending on the longitudinal pipe fitting, and an end of an output shaft 81 of the driving unit 8 extends into a corresponding transmission assembly box 3. The end of the output shaft 81 has a first bevel gear 82, and the upper end of the screw unit 5 has a second bevel gear 53 matched to the first bevel gear 82 in transmission.

Figure 3:
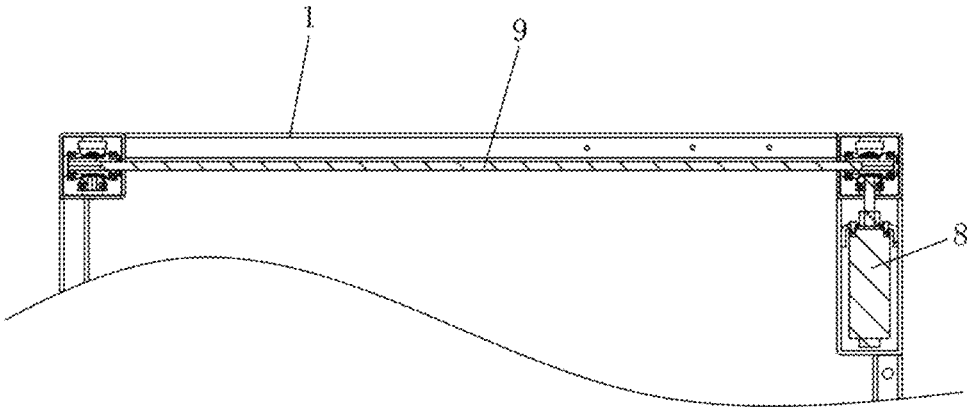
FIG. 3 is a schematic view of a transverse sectional structure of Example 1 according to the present disclosure.

The above structure has realized that the driving unit 8 drives a set of lifting mechanisms to lift, and in order to make two sets of lifting mechanisms move synchronously, in the example, as shown in FIGS. 1 and 3, a transmission shaft 9 is arranged between the two sets of lifting mechanisms, that is, the screw units 5 on the two outer sleeves 2 are connected through the transmission shaft 9 in transmission to make the two sets of lifting mechanisms can move synchronously.

Returning to the above contents, the first bevel gear 82 is matched to the second bevel gear 53 in transmission, and correspondingly, two ends of the transmission shaft 9 have third bevel gears 91, and the third bevel gears 91 at the two ends are located in the corresponding transmission assembly boxes 3 and are matched to the corresponding first bevel gear 82 and/or the second bevel gear 53 in transmission.

Thus, as the power source, the driving unit 8 can drive the output shaft 81 and the first bevel gear 82 to rotate, and the rotation of the first bevel gear 82 causes the second bevel gear 53 and the third bevel gear 91 to rotate. The rotation of the second bevel gear 53 drives the screw units 5 to rotate; and the rotation of the third bevel gear 91 drives the transmission shaft 9 to rotate to realize the synchronous action of the screw units 5 at both ends.

Figure 4:
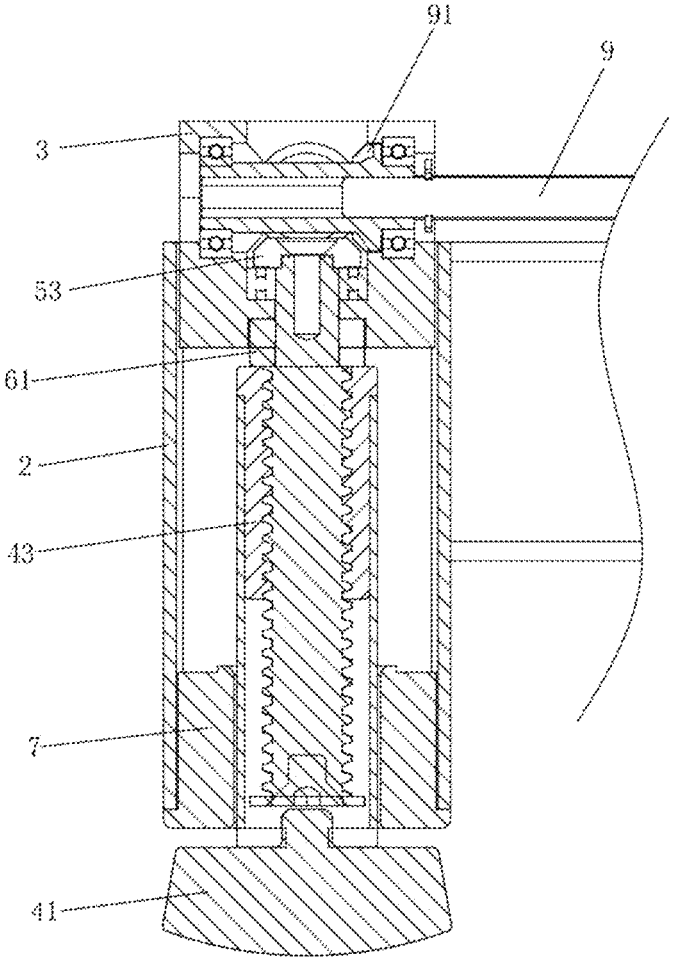
FIG. 4 is a schematic sectional view of matching structures of a transmission shaft, a screw unit and a support unit according to the present disclosure.
Figure 5:
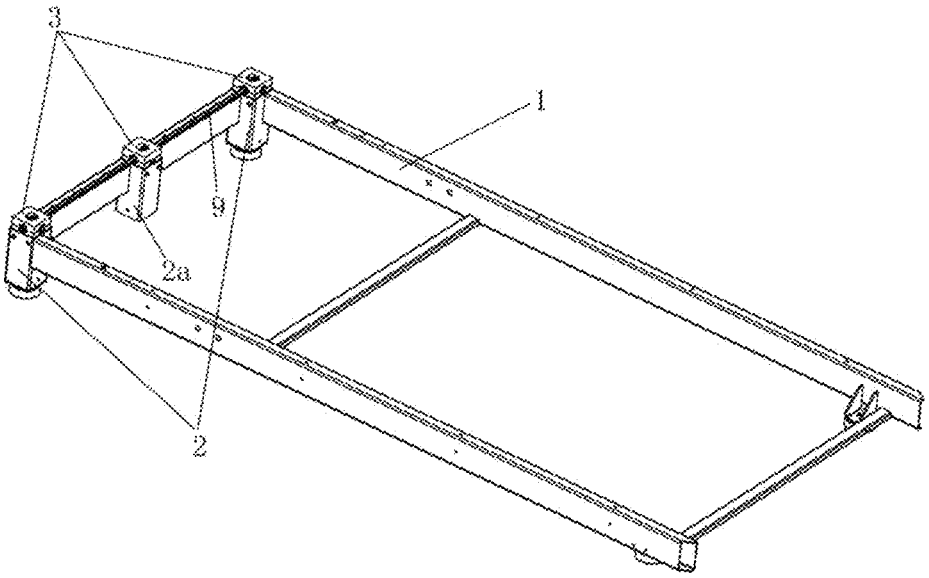
FIG. 5 is a schematic structural view of Example 2 according to the present disclosure.

The layout of the relevant components of the screw units 5 on a side away from the driving unit 8 can be seen in FIG. 4.

Example 2

Compared with Example 1, the difference of the example is that an arrangement position of the driving unit is different and the different related transmission components are required due to different arrangement positions, and other conditions are the same.

With reference to FIGS. 4-8, in the example, a base 1 has at least three outer sleeves 2 at one end, the outer sleeves 2 at two sides are the same as those in Example 1, and inner sleeves 42, threaded sleeves 43, and screw units 5 are arranged in an interior of the outer sleeve 2. While a middle outer sleeve 2*a* at a middle is configured to mount a driving unit 8, and likewise, the driving unit 8 can be a motor.

Figure 6:
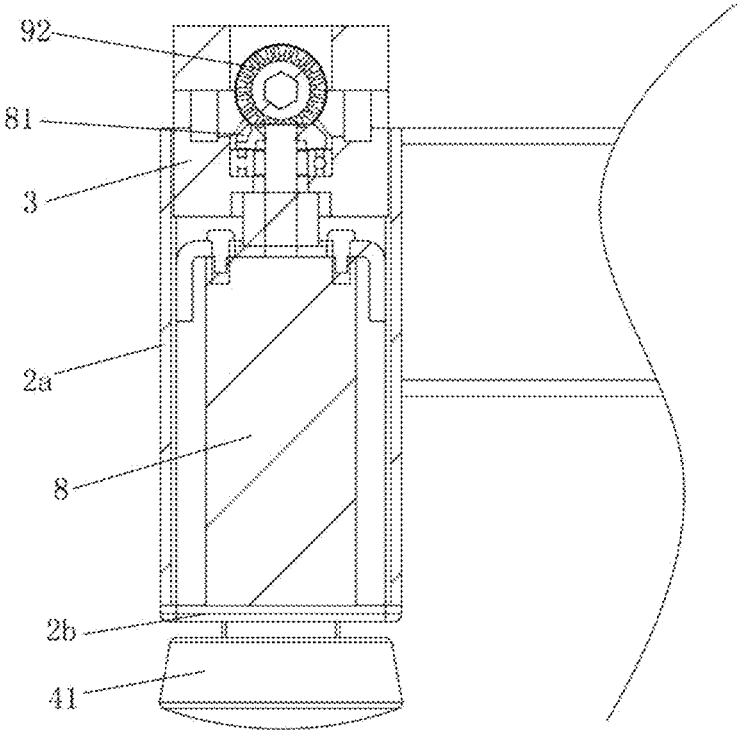
FIG. 6 is a schematic view of a sectional structure of a driving motor of Example 2 according to the present disclosure.
Figure 7:
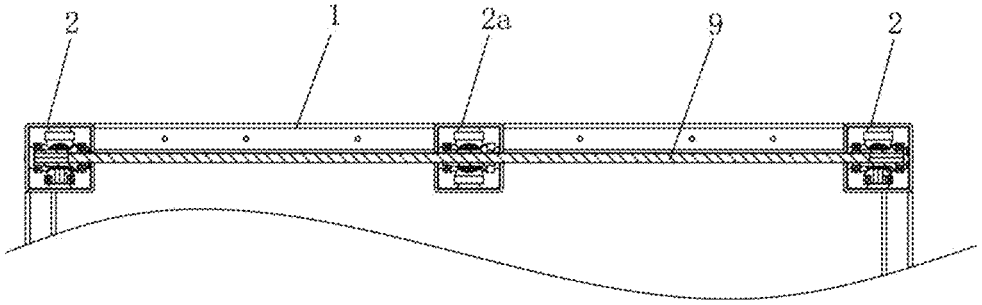
FIG. 7 is a schematic view of a transverse sectional structure of Example 2 according to the present disclosure.
Figure 8:
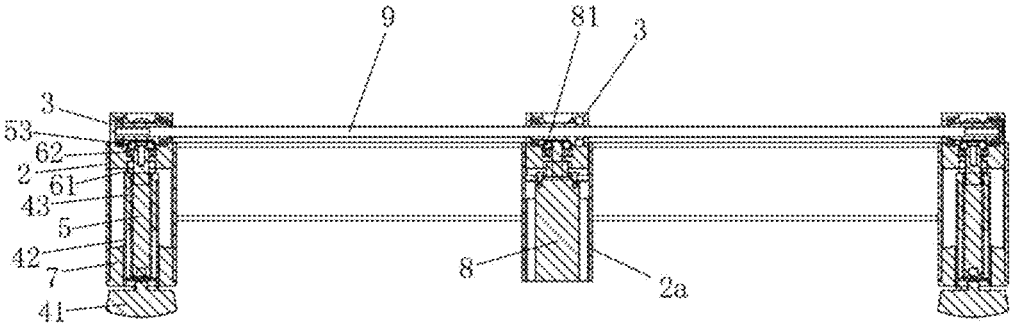
FIG. 8 is a schematic view of a longitudinal sectional structure of Example 2 according to the present disclosure.

The middle outer sleeve 2*a* for mounting the driving unit 8 differs from the other outer sleeves 2 in that its bottom has a base plate 2*b* for supporting the driving unit 8 and the base plate 2*b* can be integrally formed with the middle outer sleeve 2*a*, and the middle outer sleeve 2*a* can also be arranged with a support block 41 at a bottom, as shown in FIG. 6.

In the example, the middle outer sleeve 2*a* for mounting the driving unit 8 can also be equipped with a transmission assembly box 3, a first bevel gear 82 corresponding to the driving unit 8 is located in the transmission assembly box 3, a transmission shaft 9 penetrates through and is arranged at the transmission assembly box 3, and the transmission shaft 9 is located in the transmission assembly box 3 and has an additional bevel gear, such as a fourth bevel gear 92, which is matched to the first bevel gear 82 of the driving unit 8 in transmission.

In the example, the driving unit 8 adopts a built-in layout, and the lifting of the base 1 has been realized by the transmission of force to the screw units 5 at both ends through the transmission shaft 9.

Example 3

Compared with Example 1, the difference of the example is that an arrangement position of the driving unit is different and the different related transmission components are required due to different arrangement positions, and other conditions are the same.

Figure 9:
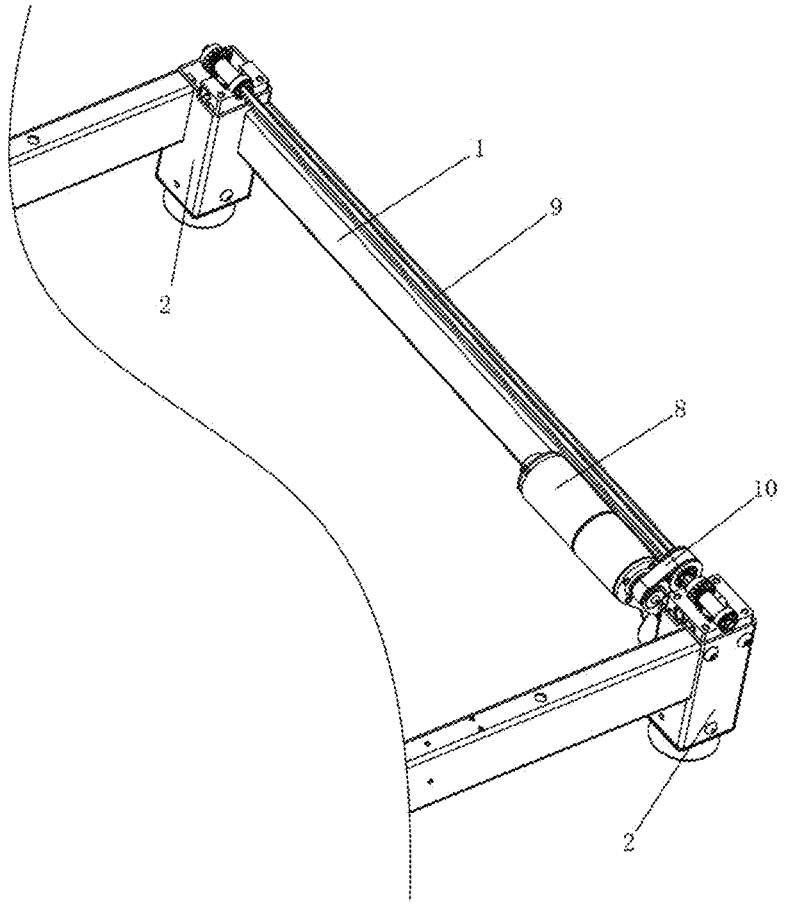
FIG. 9 is a schematic structural view of Example 3 according to the present disclosure.
Figure 10:
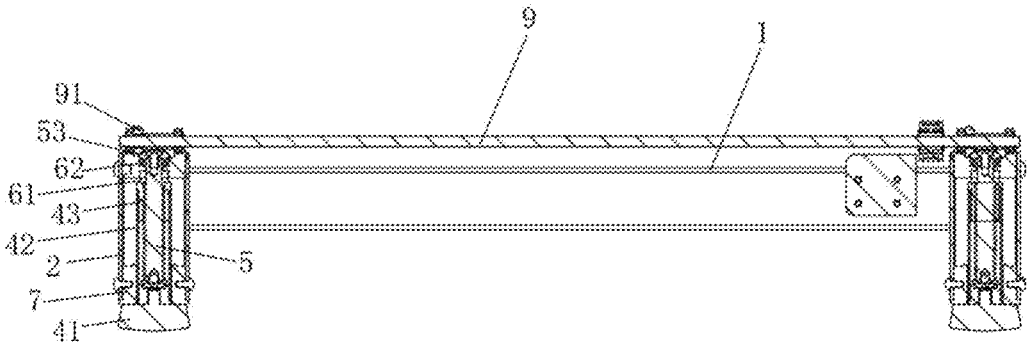
FIG. 10 is a schematic view of a longitudinal sectional structure of Example 3 according to the present disclosure.

With reference to FIGS. 4, 9 and 10, in the example, two ends of one side of a base 1 have corresponding components for lifting, such as outer sleeves 2, inner sleeves 42, threaded sleeves 43, and screw units 5. A driving unit 8 can be arranged on a transverse pipe between two outer sleeves 2 or on an extending component of the transverse pipe; a belt pulley is arranged on a transmission shaft 9 for connecting the two screw units 5 in transmission, and can drive the transmission shaft 9 to rotate synchronously. The two are circumferentially positioned; correspondingly, a belt pulley is also arranged on an output shaft 81 of the driving unit 8, transmission belts 10 are mounted on two belt pulleys; and the driving unit 8 can also be a motor.

That is, in the example, the driving unit 8 is connected to the transmission shaft 9 through the transmission belt 10 in transmission, and then a third bevel gear 91 corresponding to two ends of the transmission shaft 9 is connected to a second bevel gear 53 at an upper end of a screw unit 5 in transmission, thus driving two screw units 5 to move synchronously to realize the lifting of the base 1.

Example 4

Compared with Example 1, the difference of the example is that a driving unit is a hand-cranking mechanism, and other conditions are the same.

With reference to FIGS. 1-10, in the example, at least one end of a transmission shaft 9 extends outside a corresponding transmission assembly box 3, and the transmission shaft 9 is rotated by a hand-cranking mechanism (not shown) matched to its shape, thus driving a corresponding screw unit 5 to rotate to lift the base 1.

The above examples are only used to illustrate, but not to limit the technical solutions of the present disclosure. Although the present disclosure has been described in detail with reference to the foregoing examples, those ordinary skilled in the art are to be understood that the technical solutions described in the foregoing examples can still be modified, or some technical features can be replaced by equivalents; while these modifications or substitutions do not make the essence of the corresponding technical solutions deviate from the spirit and scope of the technical solutions of various examples of the present disclosure.

The invention claimed is:

1. A treadmill lifting base, comprising:

a base;

a driving unit arranged on the base;

a plurality of support units, at least a part of the support units being arranged on a ground surface, and comprising threaded sleeves; and a plurality of screw units threadedly and respectively arranged on the threaded sleeves, and directly connected to the driving unit in transmission or connected to the driving unit through a plurality of transmission components in transmission, each of the screw units comprising or being arranged with a matching portion capable of driving the base to move synchronously, and at least one end of the base being capable of lifting along with the screw unit when the screw unit is driven by the driving unit to rotate, wherein each support unit comprises a support block capable of being arranged on the ground surface, an inner sleeve positioned on the support block, and one of the threaded sleeves arranged at the inner sleeve, the one of the threaded sleeves being positioned circumferentially relative to the inner sleeve.

2. The treadmill lifting base according to claim 1, wherein a polygonal positioning piece is fixedly arranged on the support block, a lower end of the inner sleeve is fitted to the polygonal positioning piece, and a shape of at least the lower end of the inner sleeve is matched to a shape of the polygonal positioning piece to make the inner sleeve circumferentially positioned relative to the polygonal positioning piece;

each of the threaded sleeves comprises a built-in portion built into the inner sleeve and a radially extending outer edge portion, the radially extending outer edge portion being arranged at an upper end of the inner sleeve;

an outer diameter of the radially extending outer edge portion is matched to an outer diameter of the inner sleeve, the radially extending outer edge portion being flush with two opposite walls of the inner sleeve; and the threaded sleeve, the inner sleeve and the polygonal positioning piece are all square in shape.

3. The treadmill lifting base according to claim 1, wherein the base comprises a plurality of outer sleeves for respectively assembling the plurality of screw units and/or the plurality of support units, the plurality of outer sleeves are respectively arranged with transmission assembly boxes capable of being respectively positioned relative to the plurality of outer sleeves, upper ends of the plurality of screw units respectively penetrate through through-holes on the transmission assembly boxes and respectively extend into the transmission assembly boxes, and are respectively connected to the plurality of transmission components respectively arranged in the transmission assembly boxes in transmission, and the plurality of transmission components are connected to the driving unit in transmission.

4. The treadmill lifting base according to claim 3, wherein two sides of one end of the base respectively have two of the plurality of outer sleeves, and two of the plurality of screw units respectively on the two of the plurality of outer sleeves are connected through a transmission shaft in transmission to cause the two screw units to move synchronously.

5. The treadmill lifting base according to claim 4, wherein a first bevel gear is connected to the driving unit in transmission, arranged in a corresponding transmission assembly box and connected to at least a second bevel gear on the upper end of one of the screw units and a third bevel gear on the transmission shaft in transmission.

6. The treadmill lifting base according to claim 5, wherein the driving unit is built into the base and connected to the first bevel gear in transmission, the first bevel gear is connected to a fourth bevel gear on the transmission shaft in transmission, and two ends of the transmission shaft extend into two corresponding transmission assembly boxes and are connected to the second bevel gear on the upper end of the screw unit through a corresponding bevel gear in transmission.

7. The treadmill lifting base according to claim 6, wherein the driving unit is connected to the transmission shaft through a transmission belt in transmission, and the two ends of the transmission shaft extend into the two corresponding transmission assembly boxes and are connected to the second bevel gear on the upper end of the screw unit through the corresponding bevel gear in transmission.

8. The treadmill lifting base according to claim 3, wherein each screw unit comprises a screw upper portion and a screw lower portion, the screw upper portion penetrates through the through-hole on the corresponding transmission assembly box and extends into the corresponding transmission assembly box, and an outer diameter of the screw lower portion is greater than a diameter of the through-hole to form the matching portion; and an outer diameter of the screw upper portion is matched to the diameter of the through-hole.

9. The treadmill lifting base according to claim 8, wherein a bearing is arranged between a portion of the screw upper portion located in the corresponding transmission assembly box and the corresponding transmission assembly box;

a plane bearing is arranged between a portion of the screw upper portion located outside the corresponding transmission assembly box and the corresponding transmission assembly box, an outer diameter of the plane bearing is greater than the diameter of the through-hole, and when the screw unit is driven to rotate upwards, the base is driven to move synchronously by the cooperation of the matching portion, the plane bearing and a corresponding wall of the corresponding transmission assembly box;

the corresponding outer sleeve is fixedly connected to the corresponding transmission assembly box through a fastener;

a sliding sleeve is arranged between a lower end of the corresponding outer sleeve and a corresponding inner sleeve, and slidably sleeved on the corresponding inner sleeve;

the corresponding outer sleeve is fixedly connected to the sliding sleeve through a fastener; and the driving unit is a motor or a hand crank.

* * * * *